US006134738A

United States Patent [19]

Weber et al.

[11] Patent Number: 6,134,738

[45] Date of Patent: Oct. 24, 2000

[54] BRUSH CONSTRUCTION FOR CLEANING TOILET BOWLS

[75] Inventors: Franz-Josef Weber; Horst-Heinrich Weizenkorn, both of Huerth, Germany

[73] Assignee: Bintraco GmbH, Bodolz, Germany

[21] Appl. No.: 09/234,918

[22] Filed: Jan. 21, 1999

Related U.S. Application Data

[63] Continuation-in-part of application No. 09/085,688, May 27, 1998, abandoned.

[51] Int. Cl.[7] ..... A46B 15/00

[52] U.S. Cl. ..... 15/144.1; 15/145; 15/160; 15/172; 15/176.2

[58] Field of Search ..... 15/144.1, 145, 15/160, 164, 172, 176.1, 176.2

[56] References Cited

U.S. PATENT DOCUMENTS

| | | | |
|---|---|---|---|
| 116,126 | 6/1871 | Whitman | 15/176.2 |
| 750,357 | 1/1904 | Gibbons | 15/160 |
| 1,020,018 | 3/1912 | Bonin | 15/176.2 |
| 1,527,853 | 2/1925 | Ferdon | 15/176.2 |
| 1,665,988 | 4/1928 | Smith | 15/144.3 |
| 2,039,052 | 4/1936 | Beck et al. | 15/160 |
| 4,025,982 | 5/1977 | Palmer | 15/160 |
| 4,575,894 | 3/1986 | Stevens et al. | 15/172 |
| 4,819,291 | 4/1989 | Gunjian | 15/104.2 |
| 5,323,504 | 6/1994 | McKusker | 15/167.1 |
| 5,671,495 | 9/1997 | Abdo | 15/144.1 |
| 5,673,452 | 10/1997 | Chang et al. | 15/167.1 |
| 5,878,459 | 3/1999 | McParland | 15/114 |

FOREIGN PATENT DOCUMENTS

| | | |
|---|---|---|
| 92035663 | 8/1992 | Germany . |
| 9416481 | 3/1996 | Germany . |
| 29520540 | 5/1996 | Germany . |

*Primary Examiner*—Robert J. Warden, Sr.
*Assistant Examiner*—Theresa T. Snider
*Attorney, Agent, or Firm*—Horst M. Kasper

[57] ABSTRACT

A brush for the cleaning of toilet bowls has a handle which consists of an upper part and a lower part. The upper part is connected to a grip, whereas the lower part is provided with a plurality of bristles arranged on its end disposed opposite to the upper part. The upper part has a recess and the lower part is provided with a journal. The lower part has an upper section and a lower section, wherein the upper section consists of an elastic and flexible material having memory characteristics.

30 Claims, 4 Drawing Sheets

BRUSH CONSTRUCTION FOR CLEANING TOILET BOWLS

CROSS-REFERENCE TO RELATED APPLICATIONS

This application is a continuation-in-part application of another application filed May 27, 1998 and bearing Ser. No. 09/085,688 now abandoned. The entire disclosure of this latter application, including the drawings thereof, is hereby incorporated in this application as if fully set forth herein.

BACKGROUND OF THE INVENTION

1. Field of the Invention

The present invention relates to a brush, in particular for the cleaning of toilet bowls, wherein the brush has a handle with a grip at a first end and a plurality of bristles at a second end.

2. Brief Description of the Background of the Invention Including Prior Art

In order to ensure that toilet bowls will not be hotbeds for spores and bacteria, a number of toilet cleaners have been put on the market, the effective chemicals of which are acid salts, e.g. hydrogen-sulfites, or tensides. However, acid sewage impair the biological phase of sewage purification plants, whereas tensides are hardly decomposed by micro-organisms.

Due to the drawbacks mentioned, only mechanical means are suitable for removing dirt from toilet bowls which may be a hotbed for spores and bacteria. However, a large part of customary brushes is suitable only to clean the areas of the toilet bowls which are visible from the outside.

In addition, a brush for cleaning of toilet bowls is known from the German printed patent document DE 43 45 118, which brush consists of a handle having a grip at its one end and a bristle section at its other end. The first part of the bristle section is in alignment with the handle, whereas its other part is bent so that these two parts form an acute angle.

A bendable toilet-bowl brush is known from the German printed patent document G 92 03 566.3, wherein the handle of the brush is formed by an upper part and by a lower part, wherein the upper part and the lower part can be connected to each other, and can be coupled with an elastic element. The German Petit Patent DE-G 92 03 566.3 teaches a bendable toilet brush with an exchangeable brush head. A helical spring is employed which is covered with folding rubber. The presence of folding rubber or of a helical spring is very unhygienic, because toilet bowl residues like hair and sanitary pads can attach to the uneven surfaces and slots result in an implement becoming quickly unattractive.

The German Petit Patent DE-G 295 20 540 U1 to Radczimanowski teaches an electrically operated toilet brush with a removable flexible brush head. The reference proposes to employ an electric drive motor to turn and rotate the brush head.

A manual device for the cleaning of toilet bowls is taught in the German printed patent document No. DE 94 16 481 U1. The manual device is comprised of a brush body provided with a handgrip, formed by a rod-like body. The rod-like body exhibits a bendable part just above the brush body. This tool again employs a helical spring according to FIG. 3. FIG. 1 shows the employment of an elastic pin, which has about the same length as the total diameter width of the brush head. As shown in FIG. 2, the pin can bend by angles of 70 degrees and allows substantial vibrations of the brush head. Such vibrations can lead to undesired splashing of dirty water residues, which is clearly undesirable with a toilet brush.

SUMMARY OF THE INVENTION

1. Purposes of the Invention

It is an object of the present invention to provide for a brush appropriate for the complete cleaning of toilet bowls, especially for cleaning the horizontally arranged drain pipe in the lower portion of the toilet bows forming part of the odor seal.

These and other objects and advantages of the present invention will become evident from the description which follows.

2. Brief Description of the Invention

According to the present invention there is provided for a brush for cleaning toilet bowls. A handle has a first end and a second end. A grip is disposed at the first end of the handle. A threaded recess is disposed at the second end of the handle and extends in a substantially axial direction of the handle. A bristle-carrying section has a first end and a second end. A threaded journal is disposed at the first end of the bristle-carrying section. A plurality of bristles is arranged on the second end of the bristle-carrying section. The threaded journal of the bristle-carrying section is threaded into the threaded recess of the handle. The first end of the bristle-carrying section is made of an elastic and flexible material providing for a multidirectional bending of the bristle-carrying section with the plurality of bristles.

The recess can be centrically or eccentrically worked into the second end of the handle.

The journal can be centrically or eccentrically inserted into the first end of the bristle-carrying section.

The handle of the toilet brush consists of an upper part and a lower part, wherein the upper part is connected to the grip, and wherein the lower part is provided with a plurality of bristles arranged on its end opposite to the upper part. The upper part of the handle has a recess. The lower part of the handle is provided with a journal, and the lower section of the lower part consists of an elastic and flexible material.

According to the invention, the brush may optionally also be designed as follows:

a) the recess may be centrically worked into the upper part;

b) the recess may be eccentrically worked into the upper part;

c) a thread may be cut into the recess;

d) the journal may be centrically inserted into the lower part;

e) the journal may be eccentrically inserted into the lower part;

f) the journal may be provided with a thread.

According to the invention, one of the advantages of the brush is that the lower part carrying the bristle section may, in the case of wear and tear or severe soiling, be exchanged for a new lower part, whereas the upper part and the grip are reusable.

The present invention also provides for a brush for cleaning toilet bowls including a handle having a first end and a second end. A grip is disposed at the first end of the handle. A threaded recess is disposed at the second end of the handle and extends in a substantially axial direction of the handle. An intermediate section has a first end and a second end. A first threaded journal is disposed at the first end of the intermediate section. The first threaded journal of the intermediate section is threaded into the threaded recess of the handle. A second threaded journal is disposed at the second end of the intermediate section. A bristle-carrying section has a first end and a second end. A threaded recess is disposed at the first end of the bristle-carrying section and extends in a substantially axial direction of the handle. The second threaded journal of the intermediate section is threaded into the recess of the bristle-carrying section. A plurality of bristles is arranged on the second end of the bristle-carrying section. The intermediate section is made of an elastic and flexible material providing for a multidirectional bending of the bristle-carrying section with the plurality of bristles upon interaction with an external force and followed by a restoring into a released form upon disappearance of the external forces.

The intermediate section can have a diameter of from about 1.8 to 2.5 centimeters and a length of from about 2 to 3 centimeters. The intermediate section can be made of hard rubber. The journal can have a diameter of from about 0.4 to 0.6 millimeters. The journal can protrude from the intermediate section with a length of from about 1 centimeter to 1.5 centimeters.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
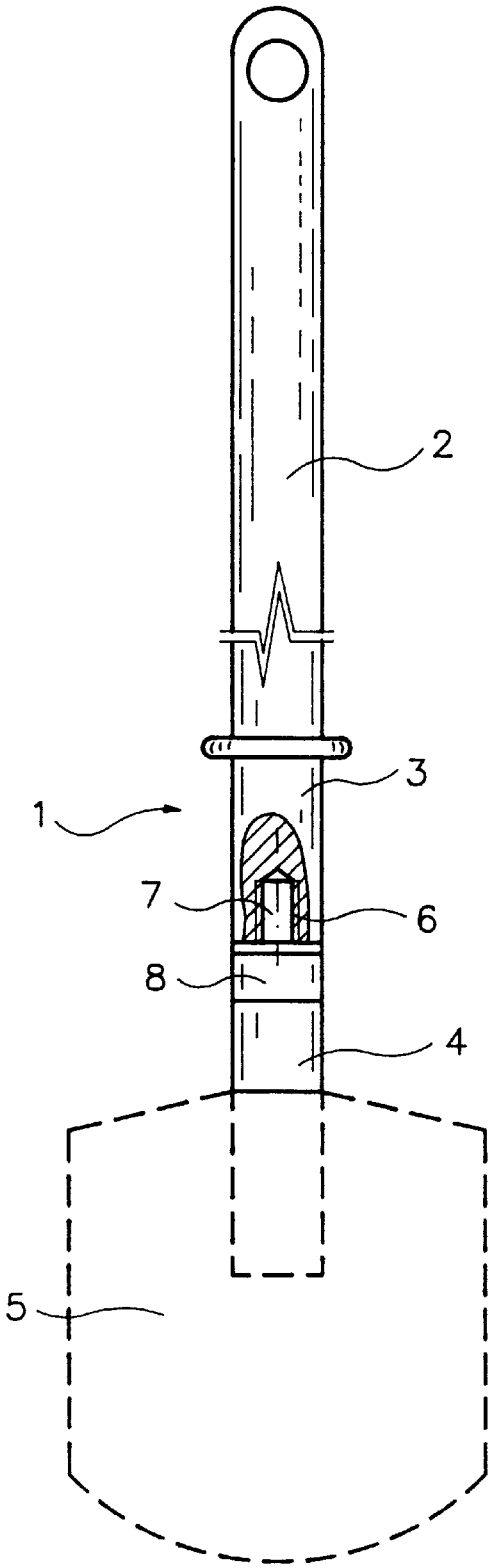
FIG. 1 is a side elevational and in part sectional view of a first embodiment of a brush in an assembled state.
Figure 2:
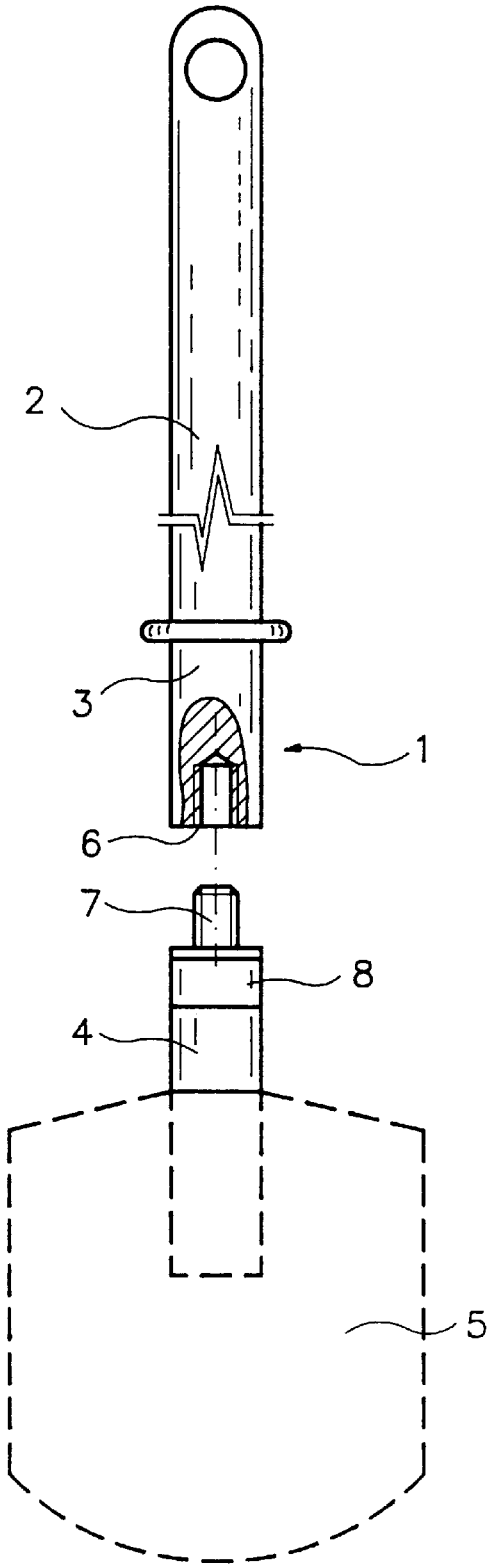
FIG. 2 is a view of the brush of FIG. 1 in a disassembled state.

The present invention provides for a brush, in particular for the cleaning of toilet bowls. A handle includes a hand grip at one end and a plurality of bristles at a second end. The handle 1 has an upper part 3 and a lower part 4. The upper part 3 is connected to the hand grip 2, and the lower part 4 is provided with a plurality of bristles 5 at its end opposite to the upper part 3. The upper part 3 has a recess 6. The lower part 4 is provided with a journal 7. The upper section 8 of the lower part 4 is made of an elastic and flexible material.

The recess 6 can be centrically or eccentrically worked into the upper part 3 and a thread can be cut into the recess 6.

The journal 7 can be centrically or eccentrically inserted into the lower part 4 of the handle, and the journal 7 can be provided with a thread.

The toilet brush consists of a handle 1 at the upper end of which a grip 2 is arranged. The handle 1 consists of an upper part 3 being connected to the grip 2 and a lower part 4. The upper part and the lower part are preferably of a round cross-section and have a diameter of from about 1 to 2 centimeters. The upper end of the upper part 3 is intended to be held by hand and the upper part 3 generally narrows down when going from its upper end to its lower end. The lower part 4 is provided with a plurality of bristles 5 arranged on its end opposite to the upper part 3. A recess 6 is worked into the upper part 3 on its end opposite to the grip 2. Furthermore, a thread is cut into the recess 6. A journal 7 is inserted into the lower part 4 on its end opposite to the bristles section. The lower part 4 and the upper part 3 may be connected with and disconnected from one another, respectively, by means of the journal 7 and the recess 6. The journal 7 is preferably a threaded pin and the recess 6 is also threaded such that the pin can be screwed into the thread of the recess.

The upper section 8 of the lower part 4 consists of an elastic and flexible material. This material may, for example, be a buffer composed of rubber and metal, wherein India rubber or neoprene with a Shore hardness between about 20 and 90 and preferably between 40 and 70 are used. This material is similar to materials commercially available for relatively hard rubber stoppers employed for closing glass equipment and for connecting glass equipment in chemical laboratory applications. The elasticity of the connection should be such that a force on the brush of from about 1 to 3 pounds results in an angle of about 20 degrees at the elastic coupling. However, this elastic and flexible material may also be an element consisting of a resilient metal which may be bent around its whole circumference by approximately 180°.

The recess 6 of the upper part 3 is provided with a threading and the journal 7 at the elastic upper section 8 of the lower part 4 is provided with a threading such that the journal 7 can be screwed into the recess 6, thereby providing a secure connection between the handle 1 and the lower part 4 of the brush.

Figure 3:
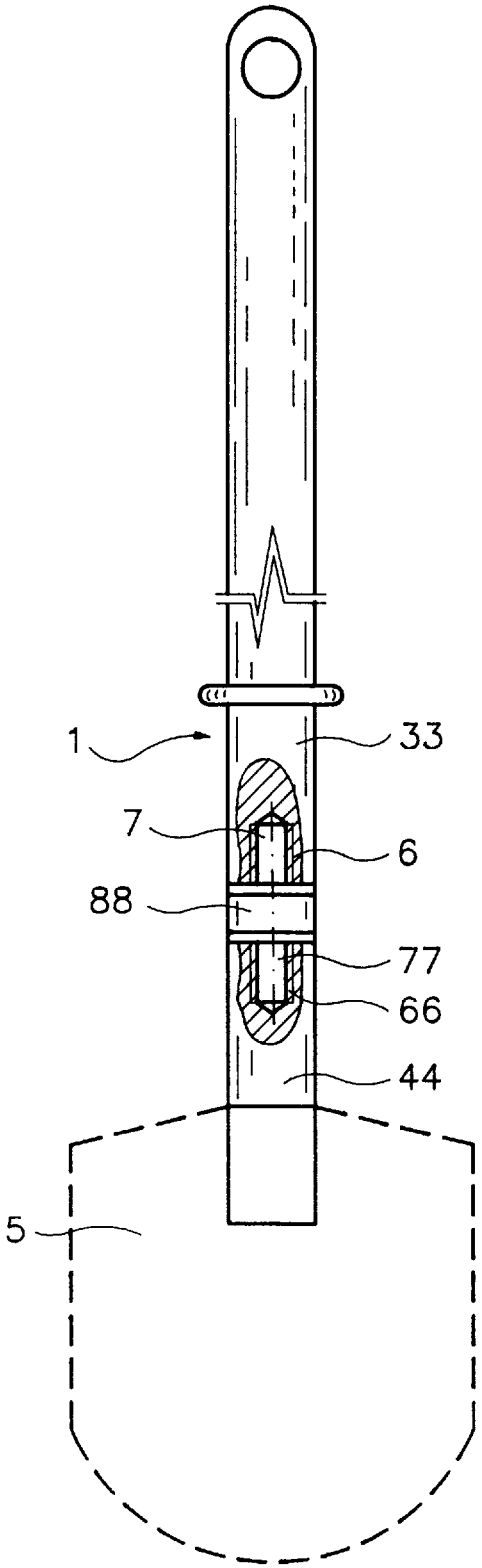
FIG. 3 is a view of a second embodiment of a brush in an assembled state.
Figure 4:
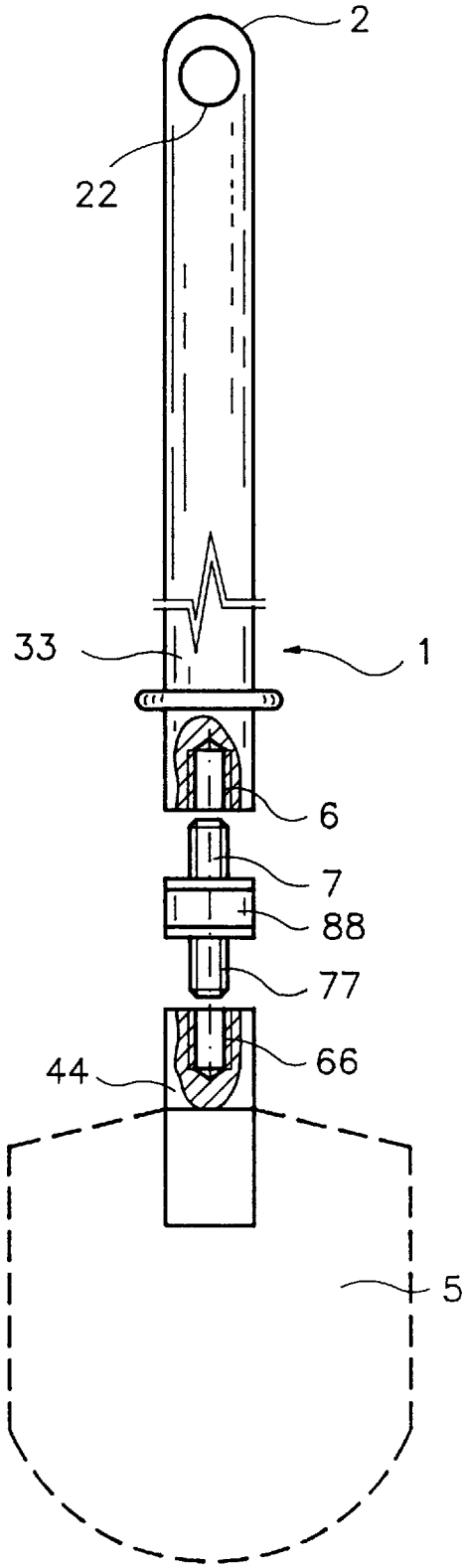
FIG. 4 is a view of the brush of FIG. 3 in a disassembled state.

According to FIG. 3, the brush is constructed of three separate parts, a handle 1, an intermediate section 88 made of an elastic and flexible material, and a plurality of bristles 5 mounted on a bristle-carrying section 44. The handle 1 has a first end 22 with a grip 2 and a second end 33 with a recess 6. The intermediate section 88 exhibits a first journal 7 to be inserted into the recess 6 of the handle. The intermediate section 88 exhibits a second journal 77. The axes of the first journal 7 and of the second journal 77 are aligned and coincide when the toilet brush is not subjected to any external forces. The bristle-carrying section 44 includes the brush head including bristles 5 and a recess 66 receiving the second journal 77 of the intermediate part 88 and . This embodiment of the invention brush enables a separation of the handle 1 of the brush as well as the bristle-carrying section 44 from the intermediate section 88 made of an elastic and flexible material.

The journal 7, 77 can have a diameter from about 0.3 to 0.8 millimeters and preferably has a diameter of from about 0.4 to 0.6 millimeters. The total length of the journal 7, 77 can be from about 1.5 to 3 centimeters and is preferably from about 2 to 2.5 centimeters. Preferably a part of the journal representing from about 0.4 to 0.6 times the length of the journal 7, 77 is solidly held in the full rubber intermediate section 88 and preferably a part of the journal from about 0.45 to 0.55 times the length of the journal 7, 77 is solidly held inside the full rubber intermediate section 88. The journal 7, 77 protrudes from the intermediate section 88 preferably with a length of from about 1 to 1.5 centimeters. The full rubber intermediate section 88 can have a diameter from about 1.5 to 3 centimeters and preferably has a diameter from about 1.8 to 2.5 centimeters. The length of the rubber intermediate section 88 can be from about 1.5 to 4 centimeters and is preferably from about 2 to 3 centimeters. The journals 7, 77 can be placed into a recess 6, 66 of the rubber connection piece 88 prior to vulcanization. Alternatively, undersized axially directed holes can be furnished or drilled into the elastic intermediate section 88 and the journals 7, 77 can be forced into these undersized holes for a solid connection to the rubber connection piece 88.

The diameter of the second end 33 of the handle 1 exhibits preferably a diameter of from about 1 to 2 centimeters and more preferably from about 1.1 to 1.5 centimeters. The length of the handle 1 can be from about 20 to 50 centimeters and is preferably from about 25 to 35 centimeters. The diameter of the bristle-carrying section 44 can be from about 2 to 4 centimeters and is preferably from about 2.5 to 3 centimeters. The second end 33 of the handle 1 and the bristle-carrying section 44 are preferably made of plastic, which is formed around the recesses 6 and 66. The diameter of the brush head formed by the bristles 5 can be from about 7 to 10 centimeters and is preferably from about 7.5 to 8.5 centimeters. The axial length of the section with the bristles 5 of the brush head can be from about 7 to 10 centimeters and is preferably from about 7.5 to 8.5 centimeters. The maximum elastic bending angle between the handle 1 and the bristle-carrying section can be from about 30 to 100° and is preferably from about 50 to 80°. The surface of both the plastic of the second end 33 of the handle 1 and of the bristle-carrying section 44 as well as of the rubber intermediate section 88 are preferably smooth, however, the part to be gripped with the hand should not be slippery. The smooth surface serves to avoid dirt accumulation.

For assembling the brush illustrated in FIG. 3, the handle 1 is connected to the intermediate section 88 by means of inserting the journal 7 of the intermediate section 88 into the recess 6 of the second end 33 of the handle 1. The journal 77 of the intermediate section 88 is then inserted into the recess 66 of the bristle-carrying section 44.

Figure 5:
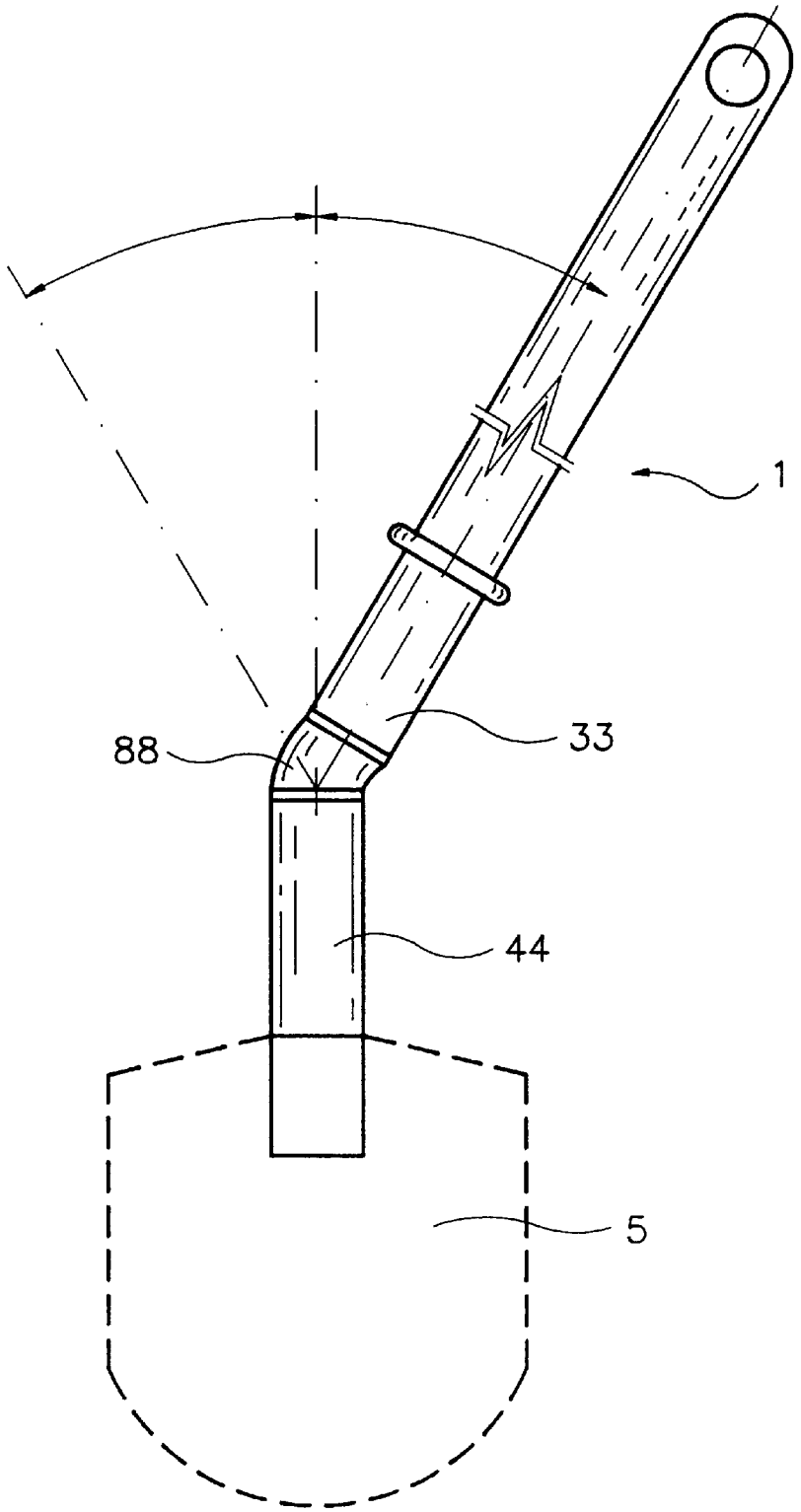
FIG. 5 is a sectional view showing the multidirectional bendability of the brush of FIGS. 1 and 3.
Figure 6:
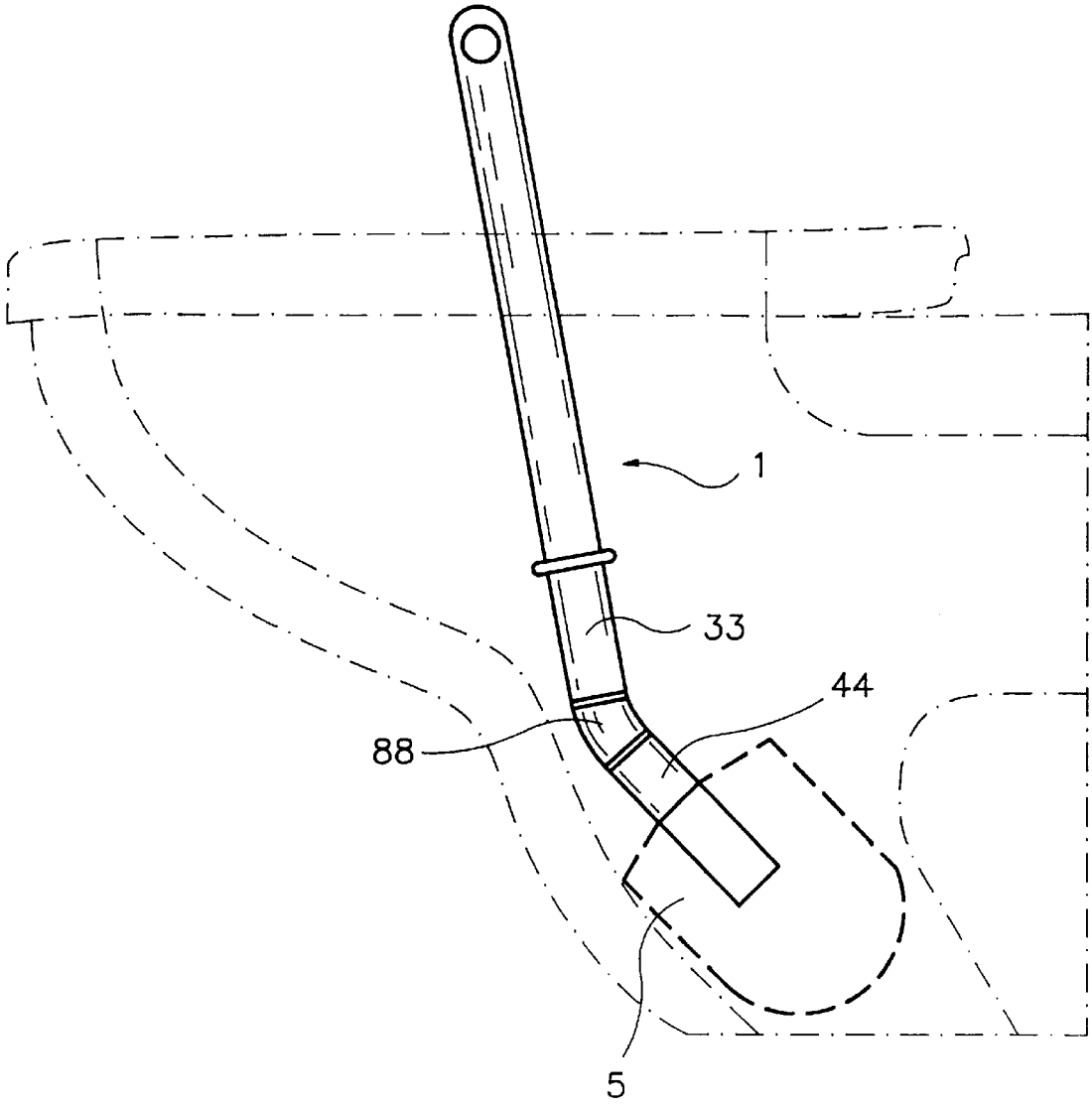
FIG. 6 is a view of the brush in an application position.

The invention brush according to FIGS. 1 and 3 is bendable multidirectionally as shown in FIG. 5.

Only materials which are substantially resistant within the pH range of 3 to 10, particularly of 4 to 8, should be used as this elastic and flexible material.

It will be understood that each of the elements described above, or two or more together, may also find a useful application in other types of brushes differing from the types described above.

while the invention has been illustrated and described as embodied in the context of a brush for cleaning toilet bowls, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A brush for cleaning toilet bowls, comprising a handle having a first end section and having a second end section;

a grip disposed at the first end section of the handle;

a threaded recess disposed at the second end section of the handle and extending in a substantially axial direction of the handle;

a bristle-carrying section having a first end and having a second end;

a threaded journal disposed at the first end of the bristle-carrying section;

a plurality of bristles arranged on the second end of the bristle-carrying section;

wherein the threaded journal of the bristle-carrying section is threaded into the threaded recess of the handle, and wherein only the first end of the bristle-carrying section is made of a solid elastic and flexible material providing for a multidirectional bending of the bristle-carrying section with the plurality of bristles.

2. The brush according to claim 1, wherein the recess is centrically worked into the second end section of the handle.

3. The brush according to claim 1, wherein the recess is eccentrically worked into second end section of the handle.

4. The brush according to claim 1, wherein the journal is centrically attached to the first end of the bristle-carrying section.

5. The brush according to claim 1, wherein the journal is eccentrically attached to the first end of the bristle-carrying section.

6. The brush according to claim 1, wherein the threaded journal of the first end is engageable and disengageable from the threaded recess of the handle.

7. The brush according to claim 1, wherein the materials employed for the brush are corrosion resistant within a pH range of from about 3 to 10.

8. The brush according to claim 1, wherein the first end of the bristle carrying section has a diameter of from about 1 to 2 centimeters.

9. A brush for cleaning toilet bowls, comprising a handle having a first end and having a second end;

a grip disposed at the first end of the handle;

a threaded recess disposed at the second end of the handle and extending in a substantially axial direction of the handle;

an intermediate section having a first end and having a second end;

a first threaded journal disposed at the first end of the intermediate section, wherein the first threaded journal of the intermediate section is threaded into the threaded recess of the handle;

a second threaded journal disposed at the second end of the intermediate section;

a bristle-carrying section having a first end and having a second end;

a threaded recess disposed at the first end of the bristle-carrying section and extending in a substantially axial direction of the handle, wherein the second threaded journal of the intermediate section is threaded into the recess of the bristle-carrying section;

a plurality of bristles arranged on the second end of the bristle-carrying section;

wherein the intermediate section is made of an elastic and flexible material providing for a multidirectional bending of the bristle-carrying section with the plurality of bristles upon interaction with an external force and followed by a restoring into a released form upon disappearance of the external forces.

10. The brush for cleaning toilet bowls according to claim 9, wherein the intermediate section has a diameter of from about 1.8 to 2.5 centimeters;

wherein the intermediate section has a length of from about 2 to 3 centimeters;

wherein the elastic and flexible material is a hard rubber;

wherein the first threaded journal and the second threaded journal have a diameter of from about 0.4 to 0.6 millimeters;

wherein the first threaded journal and the second threaded journal protude from the intermediate section with a length of from about 1 centimeter to 1.5 centimeters.

11. A brush for cleaning of toilet bowls comprising:

an upper part (3) having a first and a second end: the first end containing a hand grip (2) and the second end having a recess (6) made therein;

a lower part (4) provided with a plurality of bristles (5);

an upper section (8) detachably attached to the lower part (4) and provided with a journal (7) for inserting into the recess (6) of the upper part wherein only the upper section (8) is a solid material section and made of an elastic and flexible material.

12. The brush according to claim 11, wherein the recess (6) is centrically worked into the upper part (3).

13. The brush according to claim 12, wherein a thread is cut into the recess (6).

14. The brush according to claim 12, wherein the journal (7) is eccentrically attached to the upper section (8).

15. The brush according to claim 14, wherein the journal (7) is provided with a thread.

16. The brush according to claim 11, wherein the recess (6) is eccentrically worked into the upper part (3).

17. The brush according to claim 16, wherein a thread is cut into the recess (6).

18. The brush according to claim 11, wherein the journal (7) is centrically attached to the upper section (8).

19. The brush according to claim 18, wherein the journal (7) is provided with a thread.

20. The brush according to claim 11, wherein the length of the upper section is from about 1.5 to 4 centimeters.

21. A brush for cleaning of toilet bowls comprising a grip;

an elongated upper part having a first end and having a second end, wherein the first end of the elongated upper part contains the grip;

a recess disposed in the second end of the elongated upper part;

an elongated lower part having an upper section and having a lower section, wherein the lower section of the elongated lower part is provided with a plurality of bristles; and wherein the upper section of the elongated lower part is fully formed of an elastic and flexible material;

a journal attached to the upper section of the elongated lower part, wherein the journal reliably engages the recess.

22. The brush according to claim 21, wherein the recess is centrically worked into the second end of the elongated upper part.

23. The brush according to claim 21, wherein the recess is eccentrically worked into the second end of the elongated upper part.

24. The brush according to claim 22, wherein a thread is cut into the recess.

25. The brush according to claim 23, wherein a thread is cut into the recess (6).

26. The brush according to claim 21, wherein the journal is centrically attached to the lower end of the upper part.

27. The brush according to claim 21, wherein the journal is eccentrically attached to the lower end of the upper part.

28. The brush according to claim 26, wherein the journal is provided with a thread.

29. The brush according to claim 27, wherein the journal is provided with a thread.

30. The brush according to claim 21, wherein the journal attached to the upper section is threaded and engageable and disengageable from the recess of the elongated upper part, and wherein the recess is threaded.

* * * * *